US008005247B2

(12) United States Patent
Westerkull

(10) Patent No.: US 8,005,247 B2
(45) Date of Patent: Aug. 23, 2011

(54) POWER DIRECT BONE CONDUCTION HEARING AID SYSTEM

(75) Inventor: Patrik Westerkull, Hovås (SE)

(73) Assignee: Oticon A/S, Smorum (DK)

( * ) Notice: Subject to any disclaimer, the term of this patent is extended or adjusted under 35 U.S.C. 154(b) by 1303 days.

(21) Appl. No.: 11/569,698

(22) PCT Filed: Nov. 11, 2006

(86) PCT No.: PCT/US2006/060810

§ 371 (c)(1),
(2), (4) Date: Nov. 28, 2006

(87) PCT Pub. No.: WO2007/102894

PCT Pub. Date: Sep. 13, 2007

(65) Prior Publication Data

US 2010/0208924 A1 Aug. 19, 2010

Related U.S. Application Data

(60) Provisional application No. 60/736,451, filed on Nov. 14, 2005.

(51) Int. Cl.
*H04R 25/00* (2006.01)

(52) U.S. Cl. ..... 381/318; 381/326

(58) Field of Classification Search ..... 381/151, 381/312, 318, 326

See application file for complete search history.

(56) References Cited

U.S. PATENT DOCUMENTS

| | | | | |
|---|---|---|---|---|
| 4,887,299 | A * | 12/1989 | Cummins et al. | 381/317 |
| 4,904,233 | A * | 2/1990 | H.ang.kansson et al. | 600/25 |
| 5,091,952 | A * | 2/1992 | Williamson et al. | 381/318 |
| 2005/0008166 | A1 * | 1/2005 | Fischer et al. | 381/60 |

FOREIGN PATENT DOCUMENTS

WO WO 03001846 A1 * 1/2003

* cited by examiner

*Primary Examiner* — Walter F Briney, III

(74) *Attorney, Agent, or Firm* — Birch, Stewart, Kolasch & Birch, LLP

(57) ABSTRACT

The hearing aid system has a sound-to-vibration conversion circuitry including a microphone system, an electronic amplifier and a vibrator. A housing accommodates the vibrator. The vibrator is connected to an abutment that goes through the skin. The abutment is connected to a fixture that is anchored in the skull bone. The sound-to-vibration conversion circuitry has an A/D converter that converts an analogue microphone signal into a digital signal.

20 Claims, 5 Drawing Sheets

POWER DIRECT BONE CONDUCTION HEARING AID SYSTEM

PRIOR APPLICATION

This application is a U.S. national phase application based on International Application No. PCT/US06/60810, filed 11 Nov. 2006, claiming priority from U.S. Provisional Patent Application No. 60/736,451, filed 14 Nov. 2005.

TECHNICAL FIELD

The present invention relates to a hearing aid for patients with severe hearing losses.

BACKGROUND OF THE INVENTION

Direct bone conductors are essential for the rehabilitation of patients suffering from some specific type of hearing losses for which traditional hearing aids are insufficient.

This type of device usually consists of an external hearing aid with a vibrator that is connected via a coupling to a skin-penetrating abutment mounted on a fixture anchored in the skull bone. The coupling allows the hearing aid to be easily connected and disconnected from the abutment.

Typical for all direct bone conductors is that the vibrator of the device is directly connected to a fixture that is anchored in the skull bone so that the damping of the vibrations from the vibrator to the skull bone is negligible.

Direct bone conductors are mainly been used to rehabilitate patients with conductive or unilateral hearing losses who have a quite mild sensorineural hearing loss component.

When measuring a direct bone conductor the output from the hearing aid is vibrations that are measured in dB OFL rel 1 μN (decibel Output Force level relative 1 micro Newton). The input to the hearing aid is sound, which is measured in dB SPL (decibel sound pressure level relative 20 μPa). No feedback shall be present at the measurement setting. A standard equipment for measuring direct bone conductors is the Skull simulator TU1000, P&B research AB, Sweden.

We here define a hearing aid as a direct bone conductor that fulfills both the following two criteria:

1. A direct bone conductor that, at an input frequency sweep of 60 dB SPL, is able to perform an output for which the average of the output values for 1600 Hz and 2000 Hz is greater than 98 dB OFL (rel 1 μN)
2. A direct bone conductor that is able to perform a maximum output for which the average of the maximum output values for 1600 Hz and 2000 Hz is greater than 109 dB OFL (rel 1 μN).

Direct bone conductors for more severe sensorineural hearing loss components are available. However, these powerful direct bone conductors have several drawbacks. Due to the powerful output the patients often experience acoustic feedback problems with this kind of device. These patients also have a more severe sensorineural hearing loss component so they have a more limited dynamic range and often also a more frequency dependent hearing loss compared to patients who mainly have a conductive hearing loss. Existing powerful direct bone conduction hearing aids are based on analog amplifiers and the patient's ability to hear well is limited since the hearing aid cannot be sufficiently well adapted to compensate for the patients individual hearing loss and different sound environments. Existing powerful direct bone conduction hearing aids only use traditional omni directional microphones. This means that the possibilities for the patients to understand speech in noisy environments are limited.

SUMMARY OF THE INVENTION

The present invention provides an effective solution to the above-outlined problems with the conventional hearing aid systems. The powerful direct bone conduction hearing aid of the present invention has a digital sound processor where the audio signal can be processed and well adapted to the patients individual hearing loss. Digital filtering is used in the amplifier to compensate for the patients hearing loss at different frequencies and provide suitable compression of the signal. Signal processing is also used to adapt to different sound environments. Compared to patients using conventional direct bone conductors, these patients have a quite severe sensorineural hearing loss component that cannot be well rehabilitated with existing powerful direct bone conduction hearing aids that have analog amplification.

By the unique combination of high output, digital amplification and the direct bone conduction principle these patients can now be rehabilitated in a much more efficient way than before. Since these patients cannot be rehabilitated properly with conventional air conduction or bone conduction hearing aids, a Powerful direct bone conduction is the only type of device that could rehabilitate these patients. The invention presented here offers completely new unique possibilities to give these patients a proper hearing.

The hearing aid system of the present invention has a sound-to-vibration conversion circuitry that picks up sound with a microphone system and amplifies the signal. The signal from the amplifier goes into a vibrator that generates vibrations. The vibrator is located in a housing.

The sound-to-vibration conversion circuitry has an electronic analogue-to-digital converter (A/D converter) converting the analogue microphone signal into a digital signal. By having an A/D converter the digital signal can then be processed in a digital signal processor (DSP).

The A/D converter may be built into the microphone or may for example be located in the amplifier circuitry.

The vibrator is connected to a skin-penetrating abutment that is connected to a fixture that is anchored in the skull bone. The fixture and the abutment may be two or more separate components that are mounted together, or the abutment and the fixture may be integrated in one piece.

The microphone system may consist of a traditional omnidirectional or a two port directional microphone. In a preferred embodiment of the present invention the microphone system includes two microphones and a programmable microphone processing circuit where the sensitivity for sound coming from the front compared to sound coming from the rear is variable by programming the circuit digitally in a programmable circuit. This type of microphone system may also be based on more than two microphones but usually two microphones are sufficient for a good function. Due to the poor hearing of these patients it is critical that they can pick up as much as possible of the speech information from a person talking to them when there is for example noise coming from behind. By using directional microphones sound can be picked up more from a specific direction. This is especially important for these patients and hearing in noise is especially difficult when the amplification is just about sufficient.

For the hearing aid system of the present invention the sound-to-vibration conversion circuitry is able to convert a sound input signal of 60 dB SPL, to an output for which the average of the output values for 1600 Hz and 2000 Hz is greater than 98 dB OFL (rel 1 μN). The sound-to-vibration conversion circuitry is also able to perform a maximum output for which the average of the maximum output values for 1600 Hz and 2000 Hz is greater than 109 dB OFL (rel 1 μN).

In a preferred embodiment of the present invention the hearing aid system has two separate housings. One of the housings accommodates the microphone system and the other housing accommodates the vibrator. The housings are connected to each other with a cord. By separating the vibrator and the microphone the mechanical connection between the vibrator and the microphone is significantly reduced and therefore the vibrations from the vibrator are less likely to reach the microphone and cause feedback.

The housing that accommodates the microphone system may be a behind-the-ear unit with an ear hook so that the behind-the-ear unit can hang on the ear. Alternatively, the housing that accommodates the microphone system is a body worn unit that can for example be worn in a pocket. The behind-the-ear solutions may be more comfortable for the patients and the cord to the vibrator can be kept quite short. The vibrator is located at the side of the patients' head.

The hearing aid system of the present invention may alternatively be designed with one housing that accommodates both the vibrator, battery, amplifier and the microphone system. This may be an aesthetic solution for some patients, although the amplification cannot be as high as for a version with separate housings for the vibrator and the microphone.

The housing where the microphone system is located may have a battery that supplies the microphone and a transmitter, for example an FM transmitter, that transmits the signal wireless to a receiver located in the vibrator housing. In this case, the vibrator housing accommodates a battery that supplies the output amplifier that drives the vibrator.

Alternatively, the housing that accommodates the microphone system also accommodates the battery that supplies the output amplifier that drives the vibrator. A battery that supplies the output amplifier that drives the vibrator we here call a power battery.

The body worn design requires a longer cord but since the body worn unit can be placed more far away from the vibrator than what is possible for the behind-the-ear design. Therefore, the body worn alternative may be better than the behind-the-ear solution from a feedback point of view, especially for patients who really need a lot of amplification.

In a preferred embodiment, the hearing aid system has a programmable circuit for digitally programming the sound processing parameters of the amplifier. In this way, the hearing aid can be programmed individually for each patient or for example programmed to work well in different listening environments.

In a preferred embodiment of the present invention, the sound-to-vibration conversion circuitry has an adaptive feedback reduction circuit that can automatically reduce the gain of the sound-to-vibration conversion circuitry to avoid feedback. This adaptive feedback system is an important feature that significantly reduces the risk for feedback. The adaptive feedback system senses/measures at which frequencies it is most likely to get feedback problems or where feedback has occurred. A digital circuitry then calculates how to compensate for this by reducing the gain at certain frequencies. With feedback reduction circuitry the gain of the hearing aid can be increased a bit further without getting feedback problems compared to if no feedback reduction is used. This is very important since these patients have such a poor hearing that they are often in need for as much amplification as possible, and the unique combination of a digitally amplified powerful direct bone conductor and feedback reduction may be the only way to offer them sufficient sound information to cope well with their daily life.

In a preferred embodiment of the present invention, the sound-to-vibration conversion circuitry has a feedback suppression circuit that generates a notch filtering that can reduce the gain at a frequency where the feedback is most likely to occur. This notch filtering may be a cost efficient alternative, but is less flexible and dynamic when it comes to eliminating feedback compared to the adaptive feedback reduction solution.

DETAILED DESCRIPTION OF A PREFERRED EMBODIMENT

Figure 1:
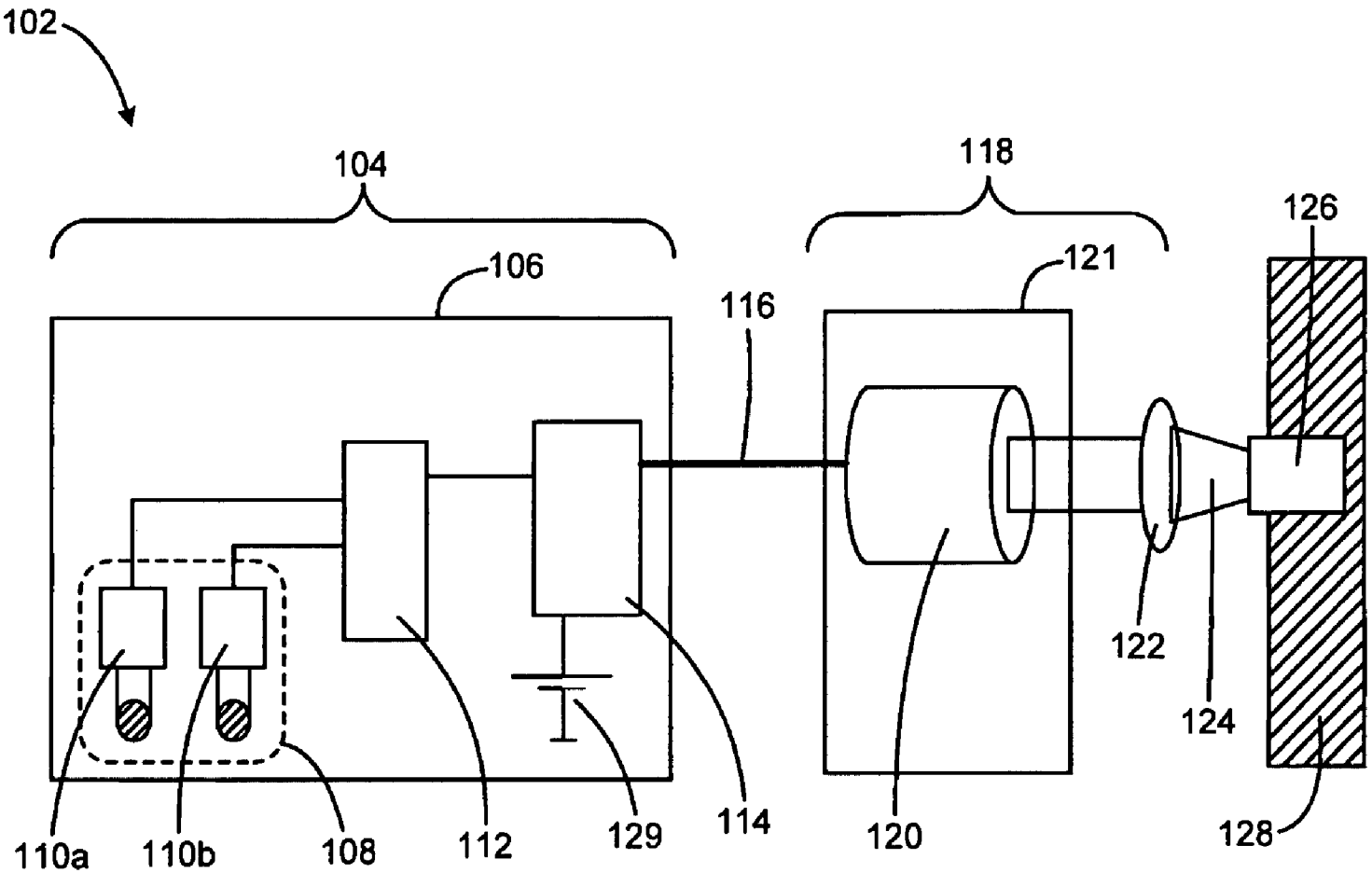
FIG. 1 is a schematic drawing of the hearing aid system of the present invention.

FIG. 1 shows a schematic drawing of a hearing aid system 102. A microphone unit 104 has a housing 106. A microphone system 108 has two microphones 110*a* and 110*b*. An A/D-converter 112 converts the analog signal from the microphones 110*a* and 110*b* to a digital signal that goes into a digital signal processing and amplifier circuit 114. The signal from the digital signal processing and amplifier circuit 114 goes via a cord 116 from the microphone unit 104 into a vibrator unit 118 where a vibrator 120 is located. The vibrator unit 118 has a housing 121.

The vibrator 120 is connected to a coupling 122 that is attached to a skin-penetrating abutment 124. The skin-penetrating abutment 124 is connected to a fixture 126 that is anchored in the skull bone 128. The electronics are powered by a battery 129.

In this way, the sound that is picked up by the microphone system 108 is amplified by the digital signal processing and amplifier circuit 114 and converted into vibrations in the vibrator 120. The vibrations from the vibrator 120 are then transmitted via the coupling 122, the abutment 124 and the fixture 126 to the skull bone 128. The vibrations can then be picked up by the patients inner ear so that the patient can hear better.

Figure 2:
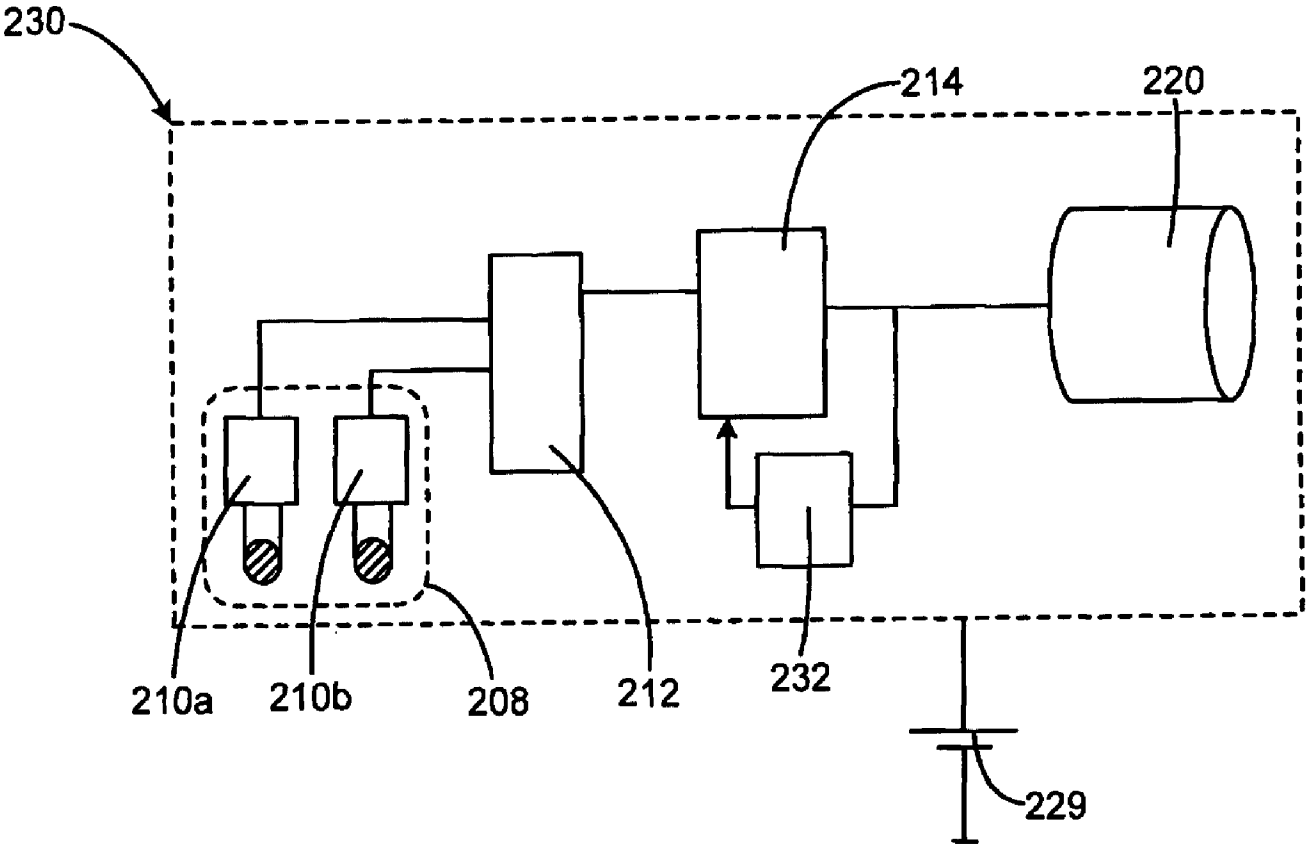
FIG. 2 is a schematic drawing of the sound-to-vibration conversion circuitry of the hearing aid system.

FIG. 2 shows a schematic drawing of the sound-to-vibration conversion circuitry 230 of the present invention. The sound-to-vibration conversion circuitry 230 has a microphone system 208 that has two microphones 210*a* and 210*b*. An A/D-converter 212 converts the analog signal from the microphones 210*a* and 210*b* to a digital signal that goes into a digital signal processing and amplifier circuit 214. An adaptive feedback reduction circuit 232 adapts the gain of the sound-to-vibration conversion circuitry 230 to minimize the risk for feedback. The signal from the digital signal processing and amplifier circuit 214 goes into a vibrator 220. The vibrator 220 converts the electrical signal into vibrations. The electronics are powered by a battery 229.

Figure 3:
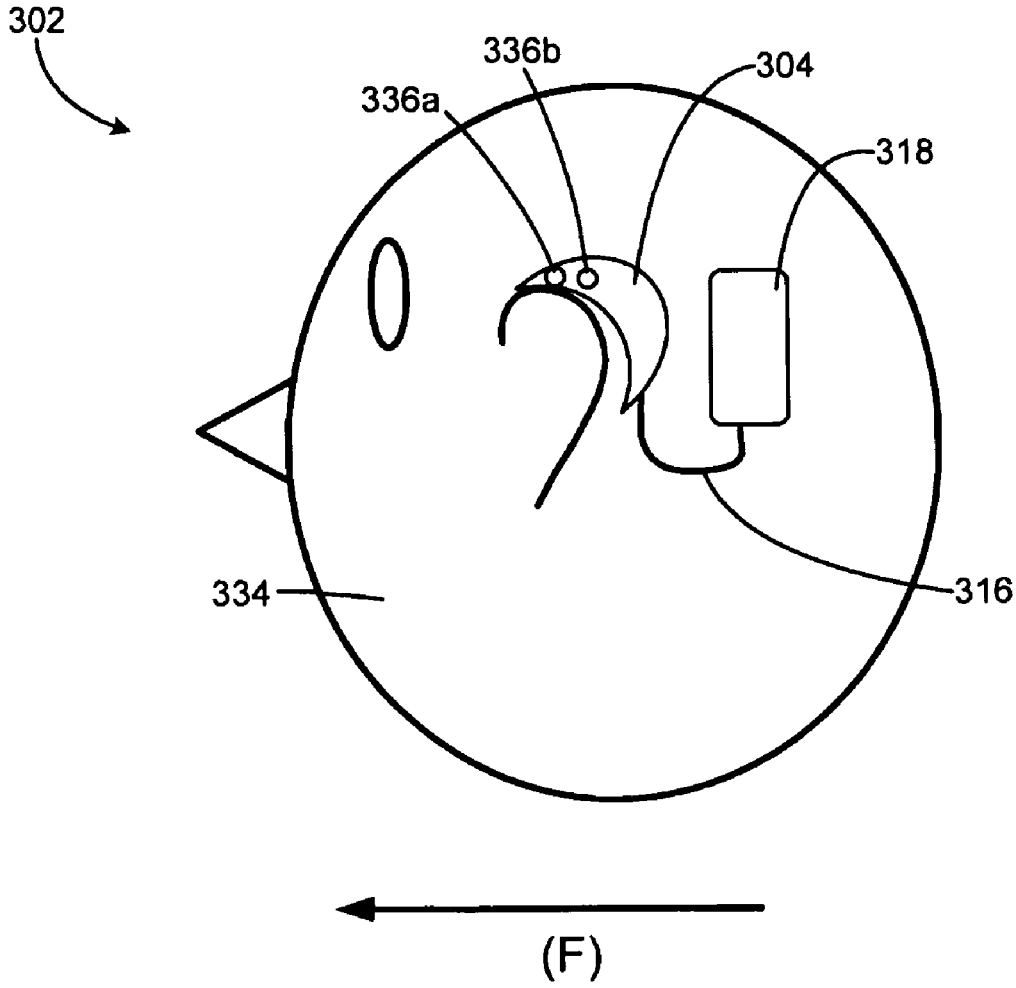
FIG. 3 is a side view of the hearing aid with a behind-the-ear microphone unit and a vibrator unit on a patient.

FIG. 3 shows the hearing aid system 302 with a behind-the-ear microphone unit 304 and a vibrator unit 318 on a patient 334. The behind-the-ear microphone unit 304 has two microphone inlets 336*a* and 336*b* for a directional microphone system as described in FIG. 2. The arrow (F) indicates the frontal direction. The microphone inlets 336*a* and 336*b* are positioned so that it is possible to have a higher sensitivity for sound coming from the frontal direction. The behind-the-ear microphone unit 304 is connected to the vibrator unit 318 with a cord 316.

Figure 4:
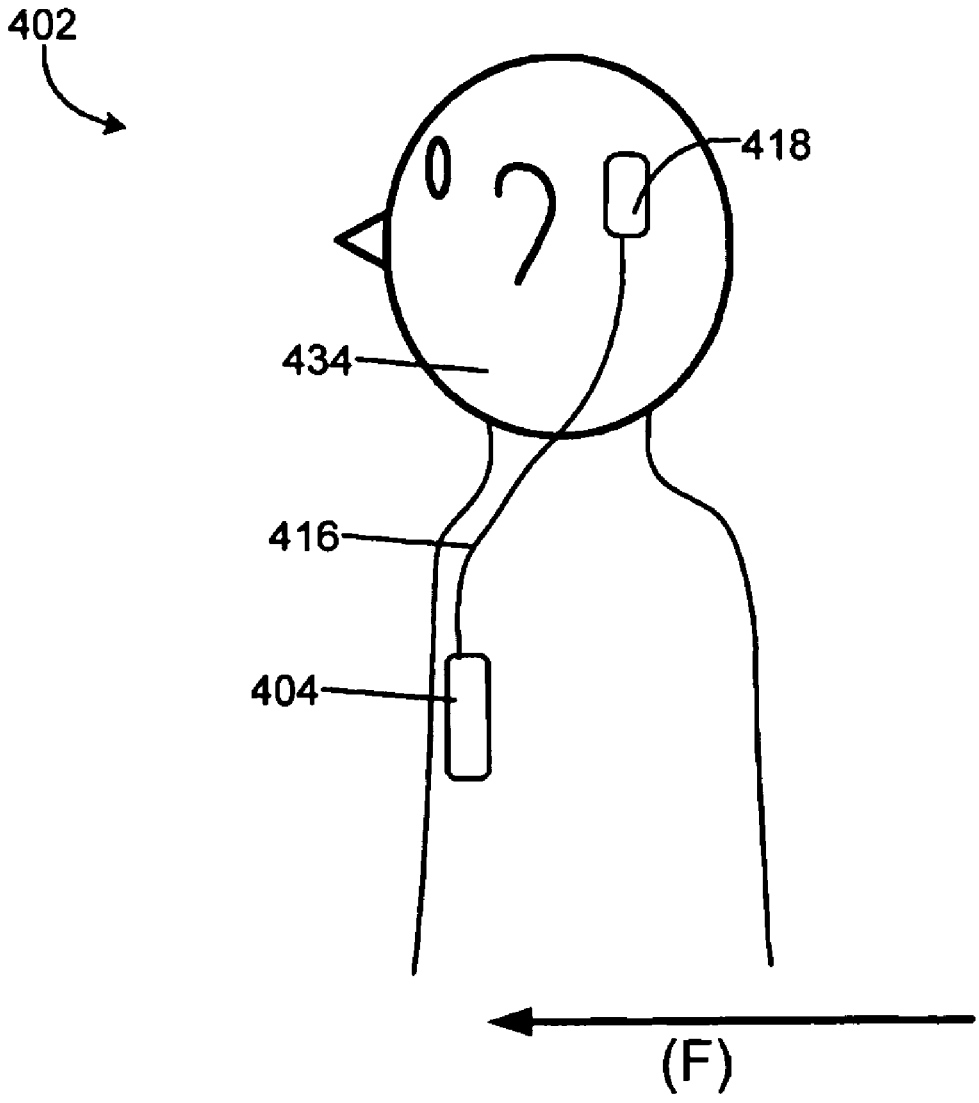
FIG. 4 is a side view of the hearing aid with a body worn microphone unit and a vibrator unit.

FIG. 4 shows the hearing aid system 402 with a body worn microphone unit 404 and a vibrator unit 418 on a patient 434. The behind-the-ear microphone unit 404 is connected to the vibrator unit 418 with a cord 416. The arrow (F) indicates the frontal direction.

Figure 5:
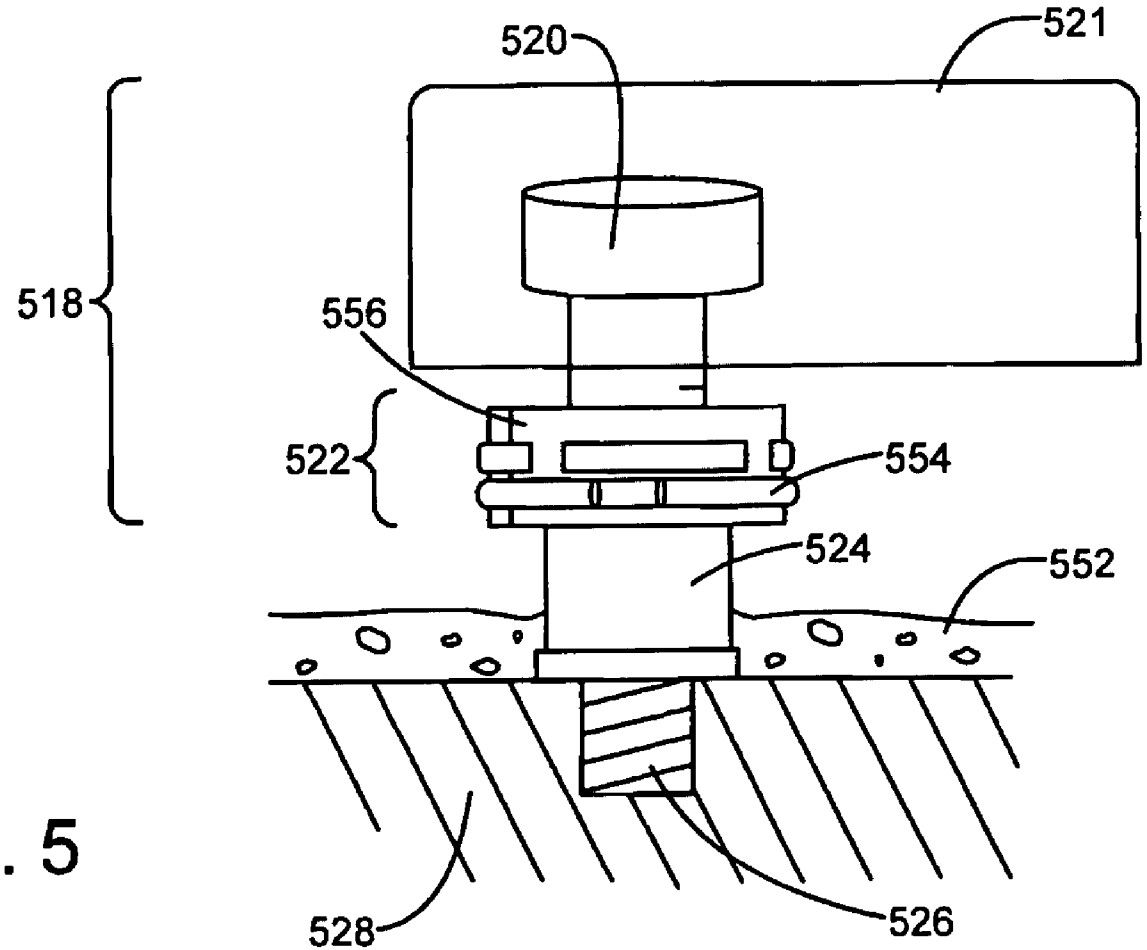
FIG. 5 is a side view of the vibrator unit and the connection to the skull bone.

FIG. 5 shows a vibrator unit 518 in which a vibrator 520 is located. The vibrator unit 518 has a housing 521 and a coupling 522. The coupling 522 connects the vibrator 520 to the skin-penetrating abutment 524. The skin-penetrating abutment 524 is connected to a fixture 526 that is anchored in the skull bone 528. The skin-penetrating abutment 524 goes through the skin 552. The coupling 522 allows the vibrator unit 518 to be easily connected and disconnected from the skin-penetrating abutment 524. In this example, the coupling 522 has a spring 554 that presses a coupling shoe 556 against the abutment 524 to connect the vibrator unit 518 to the abutment 524.

While the present invention has been described in accordance with preferred compositions and embodiments, it is to be understood that certain substitutions and alterations may be made thereto without departing from the spirit and scope of the following claims.

The invention claimed is:

1. A hearing aid system, comprising:

a sound-to-vibration conversion circuitry;

the sound-to-vibration conversion circuitry having a microphone system, an electronic amplifier and a vibrator;

a housing for accommodating the vibrator;

the vibrator being connected to an abutment adapted to extend through the skin;

the abutment being connected to a fixture adapted to be anchored in the skull bone; and the sound-to-vibration conversion circuitry having an A/D converter converting an analogue microphone signal into a digital signal, wherein the sound-to-vibration conversion circuitry converts a sound input signal of 60 dB SPL, to an output for which the average of the output values for 1600 Hz and 2000 Hz is greater than 98 dB OFL (rel 1 μN), and wherein the sound-to-vibration conversion circuitry performs a maximum output for which the average of the maximum output values for 1600 Hz and 2000 Hz is greater than 109 dB OFL (rel 1 μN).

2. The hearing aid system according to claim 1 wherein two separate housings and one of the two housings accommodates the microphone system and the other housing accommodates the vibrator.

3. The hearing aid system according to claim 2 wherein the housing that accommodates the microphone system also accommodates a power battery.

4. The hearing aid system according to claim 1 wherein the housing that accommodates the microphone system is a behind-the-ear unit with an ear hook so that the behind-the-ear unit hangs on the ear.

5. The hearing aid system according to claim 1 wherein the housing that accommodates the microphone system is a body worn unit.

6. The hearing aid system according to claim 1 wherein the housing of the vibrator also accommodates a power battery and the microphone system.

7. The hearing aid system according to claim 1 wherein the microphone system includes two microphones and a programmable microphone processing circuit where the sensitivity for sound coming from the front compared to sound coming from the rear is variable by programming the circuit digitally in a programmable circuit.

8. The hearing aid system according to claim 1 wherein the system has a programmable circuit for digitally programming the sound processing parameters of the amplifier.

9. The hearing aid system according to claim 1 wherein the sound-to-vibration conversion circuitry has an adaptive feedback reduction circuit to automatically reduce the gain of the sound-to-vibration conversion circuitry to avoid feedback.

10. The hearing aid system according to claim 1 wherein the sound-to-vibration conversion circuitry includes a feedback suppression circuit that performs a notch filtering that reduces the gain at a frequency to avoid feedback.

11. A hearing aid system, comprising:

a sound-to-vibration conversion circuitry;

the sound-to-vibration conversion circuitry having a microphone system, an electronic amplifier and a vibrator;

a housing for accommodating the vibrator;

the vibrator being connected to an abutment adapted to extend through the skin;

the abutment being connected to a fixture adapted to be anchored in the skull bone; and the sound-to-vibration conversion circuitry having an A/D converter converting an analogue microphone signal into a digital signal, wherein the housing that accommodates the microphone system is a behind-the-ear unit with an ear hook so that the behind-the-ear unit hangs on the ear.

12. The hearing aid system according to claim 11 wherein the sound-to-vibration conversion circuitry converts a sound input signal of 60 dB SPL, to an output for which the average of the output values for 1600 Hz and 2000 Hz is greater than 98 dB OFL (rel 1 μN), and wherein the sound-to-vibration conversion circuitry performs a maximum output for which the average of the maximum output values for 1600 Hz and 2000 Hz is greater than 109 dB OFL (rel 1 μN).

13. The hearing aid system according to claim 11 wherein two separate housings and one of the two housings accommodates the microphone system and the other housing accommodates the vibrator.

14. The hearing aid system according to claim 13 wherein the housing that accommodates the microphone system also accommodates a power battery.

15. The hearing aid system according to claim 11 wherein the housing that accommodates the microphone system is a body worn unit.

16. The hearing aid system according to claim 11 wherein the housing of the vibrator also accommodates a power battery and the microphone system.

17. The hearing aid system according to claim 11 wherein the microphone system includes two microphones and a programmable microphone processing circuit where the sensitivity for sound coming from the front compared to sound coming from the rear is variable by programming the circuit digitally in a programmable circuit.

18. The hearing aid system according to claim 11 wherein the system has a programmable circuit for digitally programming the sound processing parameters of the amplifier.

19. The hearing aid system according to claim 11 wherein the sound-to-vibration conversion circuitry has an adaptive feedback reduction circuit to automatically reduce the gain of the sound-to-vibration conversion circuitry to avoid feedback.

20. The hearing aid system according to claim 11 wherein the sound-to-vibration conversion circuitry includes a feedback suppression circuit that performs a notch filtering that reduces the gain at a frequency to avoid feedback.

* * * * *